US006830154B2

(12) United States Patent
Zadro

(10) Patent No.: US 6,830,154 B2
(45) Date of Patent: Dec. 14, 2004

(54) COSMETIC ARTICLES BASKET WITH ADJUSTABLY CONFIGURABLE HANDLE AND MIRROR

(76) Inventor: Zlatko Zadro, 16742 Wanderer La., Huntington Beach, CA (US) 92649

( * ) Notice: Subject to any disclaimer, the term of this patent is extended or adjusted under 35 U.S.C. 154(b) by 258 days.

(21) Appl. No.: 10/291,980

(22) Filed: Nov. 8, 2002

(65) Prior Publication Data

US 2004/0089584 A1 May 13, 2004

(51) Int. Cl.[7] ..... B65D 6/04

(52) U.S. Cl. ..... 206/581; 206/235; 206/823; 132/316; 220/756

(58) Field of Search ..... 206/581, 235, 206/823; 132/291, 316, 301, 296, 304, 102, 309; 312/224, 226, 244; 359/838, 842, 844, 872, 882; 220/9.1, 9.4, 756, 760, 771

(56) References Cited

U.S. PATENT DOCUMENTS 1,458,777 A * 6/1923 Reid ..... 132/296
1,503,378 A * 7/1924 Reid ..... 132/296
4,717,024 A * 1/1988 Djezovic ..... 206/581
6,234,340 B1 * 5/2001 Bannister ..... 220/592.2

* cited by examiner

*Primary Examiner*—Derris H. Banks
*Assistant Examiner*—Jamila Williams
(74) *Attorney, Agent, or Firm*—William L. Chapin

(57) ABSTRACT

A personal care accessory for carrying cosmetic articles and viewing one's image during their use includes a shallow open top basket which has releasably attached to opposite sides thereof an inverted U-shaped bail-type handle. The vertical segments of the handle are elastically deformable apart to disengage and reattach the handle to the basket. The handle has a straight upper central portion over which is fitted a tubular end portion of a mirror assembly support bracket, the other end of the bracket supporting an inverted U-shaped yoke which holds a mirror. The mirror is rotatable about a yoke pivot axis to a desired inclination angle, and the yoke assembly is orbitable around the handle to position the mirror at a selected polar angle.

23 Claims, 7 Drawing Sheets

COSMETIC ARTICLES BASKET WITH ADJUSTABLY CONFIGURABLE HANDLE AND MIRROR

BACKGROUND OF THE INVENTION

A. Field of the Invention

The present invention relates to articles for use by individuals in conjunction with personal grooming and beautification tasks. More particularly, the invention relates to a versatile combination face mirror and tote basket for carrying cosmetic articles and implements.

B. Description of Background Art

Most personal grooming and beautification tasks such as combing or brushing one's hair, applying make-up, eyeliner or eyeshadow and the like requires viewing one's face in a mirror. When such tasks are performed in a person's bathroom or bedroom, there are usually available wall mounted mirrors which are conveniently useable for such grooming or beautification tasks. Moreover, there is usually space available in drawers or cabinets at such locations, for storing various cosmetic articles such as hair brushes and combs, lipstick, eye brushes, powder puffs, and cosmetic preparations of various sorts. There are occasions, however, when a person prefers to perform certain grooming or beautification tasks at non-customary locations, such as at a patio table, dining room table or the like. For use on such occasions, or for traveling, a person may employ portable cosmetic case/mirror combinations which are available. However, such articles, often referred to as "compacts," usually contain a substantially small mirror, and have a minimal storage space for cosmetic preparations and/or implements. Accordingly, it would be desirable to have available a portable beauty accessory which has a reasonably large storage capacity for storing various cosmetic implements and preparations, and which has a reasonably large mirror suitable for use in grooming and applying cosmetics, but which is configurable to a relatively compact package for ease of carrying and storage. The unavailability of such an article was a motivation for the present invention.

OBJECTS OF THE INVENTION

An object of the present invention is to provide a combination carrying container for conveniently carrying and organizing personal grooming and beautification articles such as cosmetic implements including brushes, combs, lipsticks, eye makeup, applicator brushes, and the like, as well as cosmetic preparations such as lipsticks and eyeliners, and a face mirror which is adjustably attached to the container, enabling the container to be configured with the mirror adjusted to a low-profile position near an article storage area of the container, to facilitate carrying the container between various locations and storing the container when not in use, and reconfigured with the mirror in upper positions away from the article storage area for convenient viewing of the mirror during use.

Another object of the invention is to provide a cosmetic articles basket with an adjustably configurable handle and mirror which includes a basket provided with a plurality of storage compartments for carrying and organizing grooming articles and cosmetic preparations, and a handle bale which is attached at lower opposite ends thereof to the basket, the bale having an arcuately curved upper portion which serves the dual purpose of providing a convenient structure for grasping by a person's hand for carrying the basket, and serving as a pivot axle for pivotable support of a mirror which may be orbited around the axis of the axle to any desired position in a 360 degree circle, and secured at the selected position.

Another object of the invention is to provide a combination face mirror/cosmetic accessory tote basket which includes a shallow basket section with generally vertical sides and which is partitioned into a plurality of circumferentially spaced apart, vertically oriented storage areas for storing and organizing cosmetic articles, an upstanding handle bale, and a face mirror pivotably mounted to an upper horizontal portion of the handle bale.

Another object of the invention is to provide a combination face mirror/cosmetic accessory tote basket which includes a circular or oval horizontal cross section basket in which are located a plurality of circumferentially arranged, vertically disposed article storage compartments, an upstanding handle bale removably attachable at opposite lower ends thereof to opposite sides of the basket, a yoke or cradle pivotably mounted by a friction bracket to an upper portion of the handle bale, the cradle being orbitable about the handle to a desired polar angle and secureable thereto by friction between the bracket and handle, and a mirror held between horizontally opposed ends of the cradle, and rotatable therewithin to a selected inclination angle relative to the cradle.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a combination face mirror/cosmetic articles tote basket for carrying items customarily used in conjunction with personal grooming and beautification tasks, including implements such as combs, brushes, and other cosmetic articles and preparations. According to the invention, the basket has a flat bottom and curved vertical sides which together define a circular or oval cylindrical interior space. In a preferred embodiment, the interior space of the basket is divided into a plurality of adjacent article storage compartments by wire frame partitions, thus facilitating the organized storage of cosmetic articles and preparations into a desired order which facilitates their convenient access and use by a person.

According to the invention, the face mirror/cosmetic articles tote basket includes an inverted U-shaped handle bale which has a straight, horizontally disposed upper center portion, and a pair of opposed, horizontally inwardly protruding short end tangs which are releasably engageable with a pair of apertures in the sides of the basket, thus facilitating "knocking down" the basket for convenient packaging, storage and shipment.

The combination face mirror/article tote basket according to the present invention also includes a tubular friction swivel bracket which supports a mirror frame and which fits over the straight, horizontal upper center portion of the bale in frictional engagement therewith. The friction swivel is orbital around the handle bale to any desired polar angle, and secured thereat by friction between an inner elastic tube and the outer surface of the center portion of the handle bale. With this construction, the mirror/basket combination may be configured with the mirror within the mirror frame adjustably positionable to a pendent position below the upper horizontal portion of the handle, thereby facilitating grasping the upper portion of the handle for the purpose of carrying the basket. Also, the friction swivel is adjustably secureable at locations above the handle bale, enabling the mirror/basket combination to be reconfigured with the mirror positioned at higher elevations relative to the basket, when so desired by an individual using the mirror.

A preferred embodiment of a combination face mirror and cosmetic/articles tote basket according to the present invention includes a downwardly concave mirror frame support cradle or yoke which depends radially outwardly from the friction bracket and handle bale. In this embodiment, the mirror frame is pivotably supported within the cradle by a pair of horizontally disposed pivot pins located at opposed lower ends of the cradle, thus enabling the mirror to be pivoted to a desired inclination angle. The mirror of the combination mirror and accessory tote basket according to the present invention preferably has a circular or oval shape, and optionally may have two faces of different magnification powers, e.g., 5× and 7×, or 1× and 5×.

DESCRIPTION OF THE PREFERRED EMBODIMENTS

FIGS. 1–9 illustrate various aspects of a combination face mirror and cosmetics/articles carrying or "tote" basket accessory 21, according to the present invention.

Figure 1:
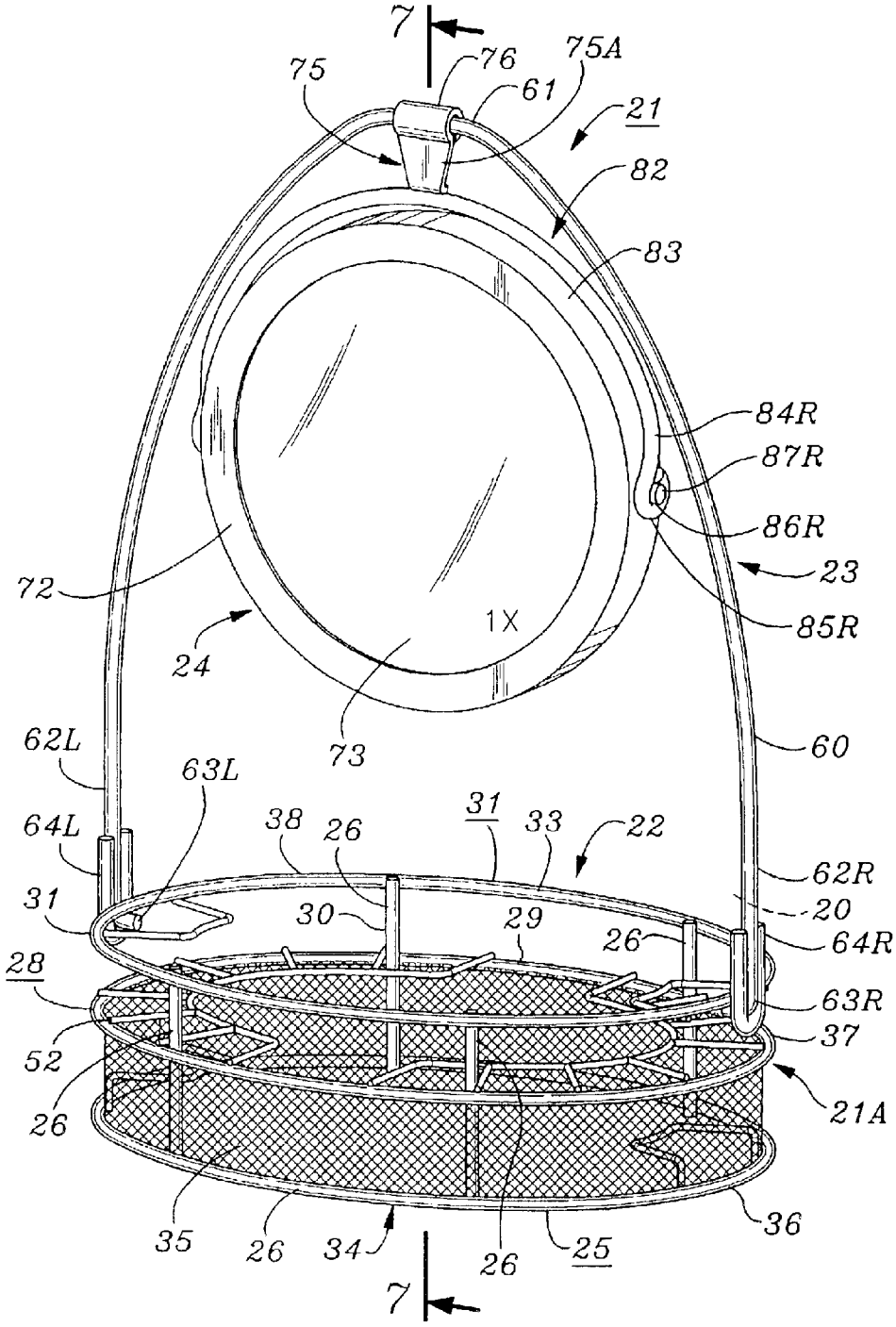
FIG. 1 is a perspective view of a combination face mirror and cosmetic articles carrying basket according to the present invention.
Figure 2:
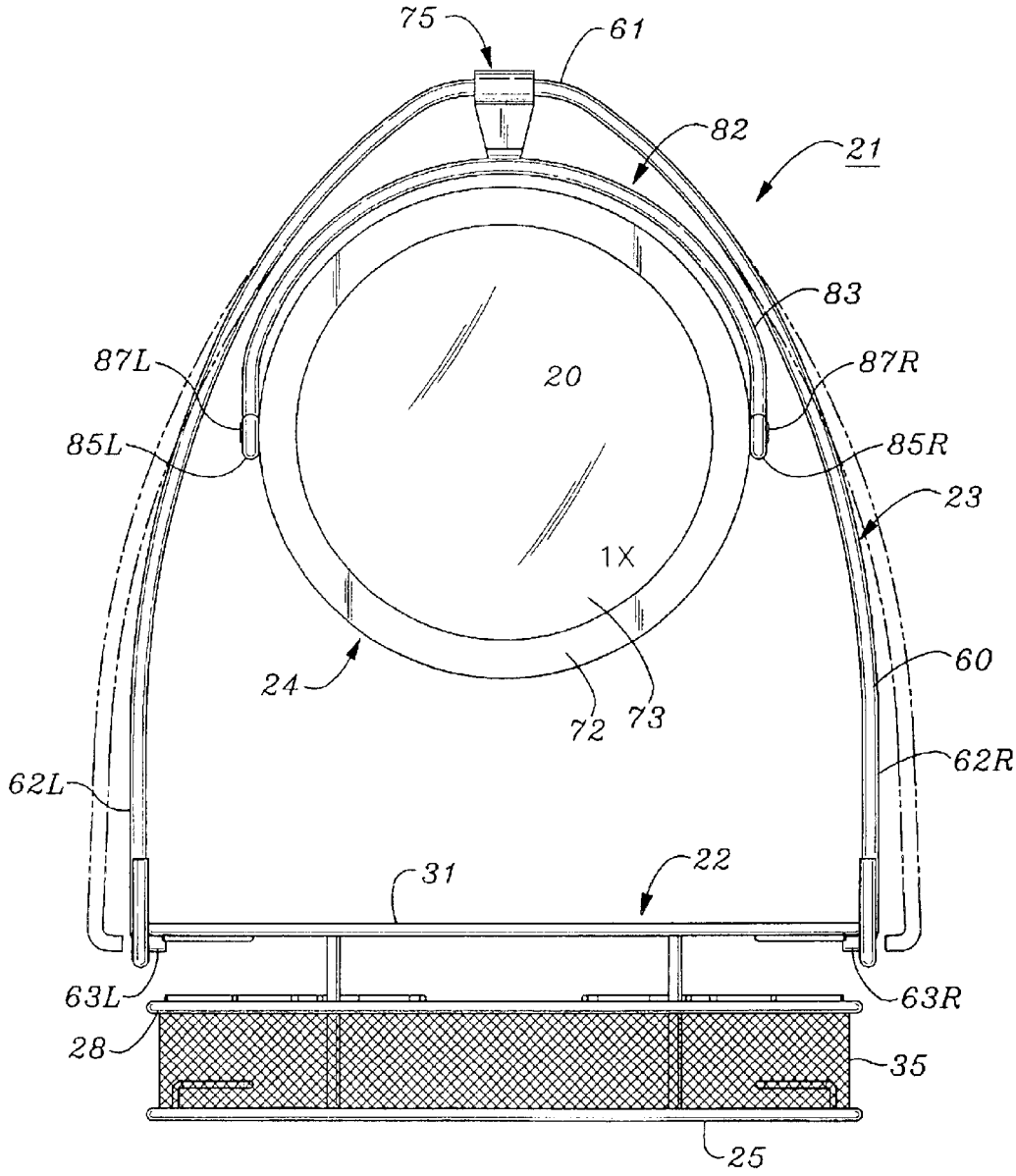
FIG. 2 is a front elevation view of the article of FIG. 1.
Figure 6:
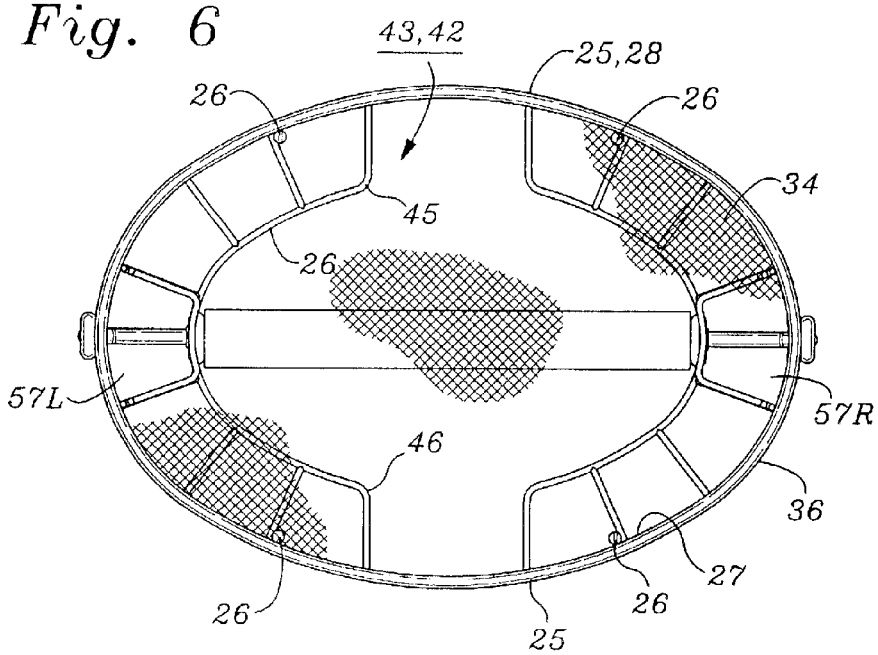
FIG. 6 is a lower plan view of the article of FIG. 1.

Referring now to FIG. 1, cosmetic basket/mirror accessory 21 according to the present invention may be seen to include a basket 22 which has an upstanding, bail-type handle 23 that supports a mirror assembly 24. Basket 22 has the shape of a short, oval cylinder that has a uniform, generally elliptical horizontal cross sectional shape. Optionally, basket 22 may have a different cross-sectional shape such as circular or rectangular. Basket 22 has a skeletal frame 21A which includes a generally flat, oval shaped base perimeter ring 25. Base perimeter ring 25 has protruding perpendicularly upwards therefrom a plurality of circumferentially spaced apart, rod-shaped support struts 26. As shown in FIG. 6, support struts 26 are attached to an inner circumferential surface 27 of base perimeter ring 25. Although the exact number of support struts 26 is not critical, in a preferred embodiment, as shown in FIG. 1, basket 22 has four struts 26 including left and right front struts 26LF, 26RF, spaced equal left and right distances from a fore-and-aft disposed minor axis of base perimeter ring 25, and a pair of left and right rear or back struts 26 LB, 26RB, longitudinally aligned with respective ones of the front struts.

Referring still to FIG. 1, it may be seen that basket 22 of basket/mirror accessory 21 includes an intermediate oval perimeter ring 28 which is shaped similarly to base perimeter ring 25, and which has an inner circumferential surface 29 that is attached to intermediate longitudinal portions 30 of struts 26, in a manner which secures the intermediate perimeter ring at a location spaced above and parallel to the base perimeter ring. Similarly, basket assembly 22 has an upper oval perimeter ring 31 which is shaped similarly to intermediate and base perimeter rings 28, 25. Upper perimeter ring 31 is spaced above and parallel to the intermediate and base perimeter rings 28 and 25, near the upper ends 32 of vertical support struts 26, and has an inner circumferential surface 33 which is fastened to the struts.

Figure 5:
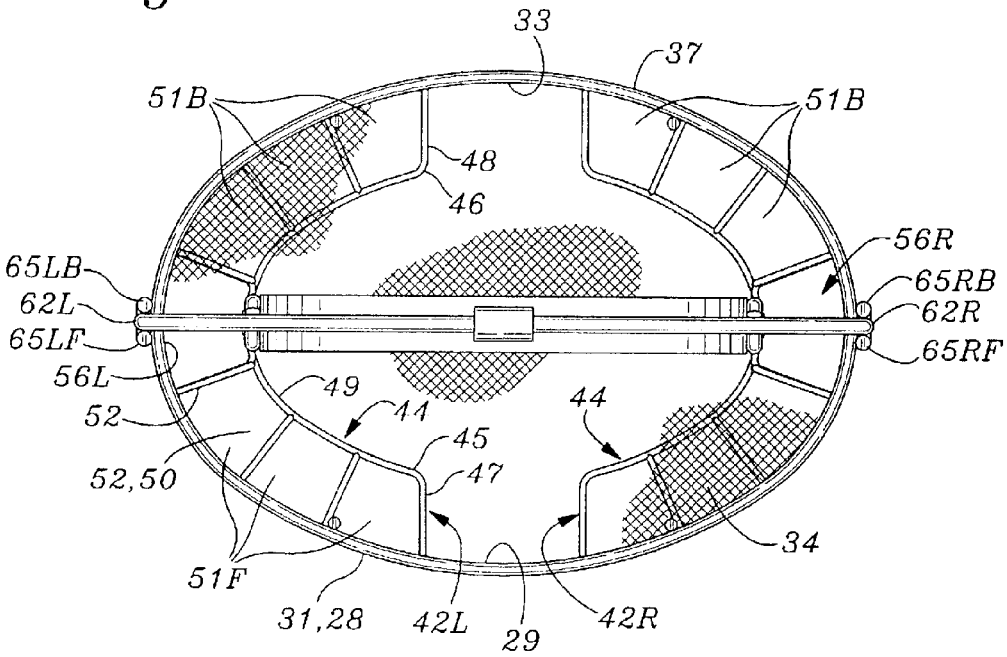
FIG. 5 is an upper plan view of the article of FIG. 1.

As shown in FIGS. 1, 5 and 6, the lower surface of basket base perimeter ring 25 has secured thereto a thin, flat base or floor panel 34, which preferably has a screen mesh construction. Basket assembly 22 also has a thin, flat, vertically disposed oval plan-view side wall 35 which fits conformally around outer circumferential sides 36 and 37 of base perimeter ring 25 and intermediate perimeter ring 28. Preferably, side wall 35 protrudes vertically upwards no further than the upper surface 38 of intermediate perimeter ring 28, and is also of screen mesh construction. In a preferred embodiment, all of the foregoing components of the basket assembly 22 are made of metal, and fastened together by welding.

As shown in FIGS. 1, 5, 6, and 7, basket 22 of cosmetics basket/mirror accessory 21 has located within an oval cylindrically-shaped interior space 39 thereof a plurality of circumferentially spaced apart, vertically disposed, open article storage compartments 40 for storing in a generally vertically disposed orientation elongated cosmetic articles such as lipstick tubes, eyeliners, brushes and the like. Article storage compartments 40 are formed by vertically aligned, parallel, horizontally disposed upper, intermediate and lower compartment divider grids 41, 42, 43 attached to inner surfaces 33, 29, and 27 of upper, intermediate and lower perimeter rings 31, 28, and 25, respectively.

As shown in FIGS. 5 and 6, intermediate divider grid 42 includes a pair of symmetrically shaped left and right halves 42L, 42R, which are spaced equidistant from a fore-and-aft disposed minor axis of basket assembly 22. Each grid half 42L, 42R includes an arcuately curved wire segment 44L, 44R which lies in a horizontal plane coextensive with that of intermediate perimeter ring 28. As shown in FIG. 5, arcuately curved wire segments 44L, 44R of intermediate divider grid 42 are parallel to and located radially inwardly from opposite lateral end portions of intermediate perimeter ring 28, and have symmetrically-shaped front and rear halves which are centered on a laterally disposed major axis of the perimeter ring. Front and rear halves of arcuately curved wire segments 44L, 44R are joined at front and rear inner ends 45, 46 thereof to inner circumferential surface 29 of intermediate perimeter ring 28 by generally radially outwardly disposed short end legs 47, 48, which are bent at an oblique angle relative to the arcuately curved parts 49 of each segment 44.

As shown in FIGS. 5 and 6, an oval annular ring-shaped space 50 is formed between each wire segment 44 and inner circumferential surface 29 of intermediate perimeter ring 28 and is segmented into a sequence of approximately rectangular plan-view grid partitions 51 by a plurality of generally radially disposed, short wire segments 52 which are spaced apart at approximately equal circumferential angles. Wire segments 52 are attached at inner radial ends thereof to arcuately curved grid segment 44, and at outer radial ends thereof to inner circumferential surface 29 of intermediate perimeter ring 28. The exact number, size and spacing of grid partitions 51 of intermediate divider grid 42 are not critical. However, in an example embodiment of basket 22 shown in FIGS. 5 and 6, each separate left and right grid half 42L, 42R of intermediate divider grid 42 has three front grid partitions and three rear grid partitions 54 which are all of approximately the same size, and which are joined to a trapezoidally-shaped end partition 55 of somewhat greater angular width.

As shown in FIGS. 1, 5, 6, and 9, upper and lower grids 41 and 43 of basket 22 are preferably sparse grids 56 and 57, respectively, each consisting of a single partition comprising a generally trapezoidal plan view mesh ring which is vertically aligned with left and right lateral end grid partitions 55 of intermediate divider grid 42. Thus, upper divider grid 41 of basket 22 has located at opposite lateral ends of a major axis of upper perimeter ring 31 left and right trapezoidally-shaped end grid partitions 56L, 56R which are vertically aligned with end partitions 55L, 55R of intermediate divider grid 42. Similarly, lower divider grid 43 of basket 22 has located at opposite lateral ends of a major axis of lower perimeter ring 25 left and right trapezoidally-shaped end partitions 57L, 57R which are vertically aligned with end partitions 55L, 55R of intermediate divider grid 42.

Referring now to FIGS. 1–9, it may be seen that handle 23 of basket/mirror accessory 21 is a bail type handle formed of an elongated circular cross-section metal rod 60 which is bent into an inverted U-shape. As may be seen best by referring to FIG. 2, the upper arcuately curved apex of the U-shaped handle is altered by the presence of a straight, laterally centrally located horizontal section 61. Also, the lower ends of left and right vertical side segments 62L, 62R of handle rod 60 have at the lower ends thereof connector tangs 63L, 63R which are bent horizontally inwards towards one another at right angles to the vertical side segments.

Figure 3:
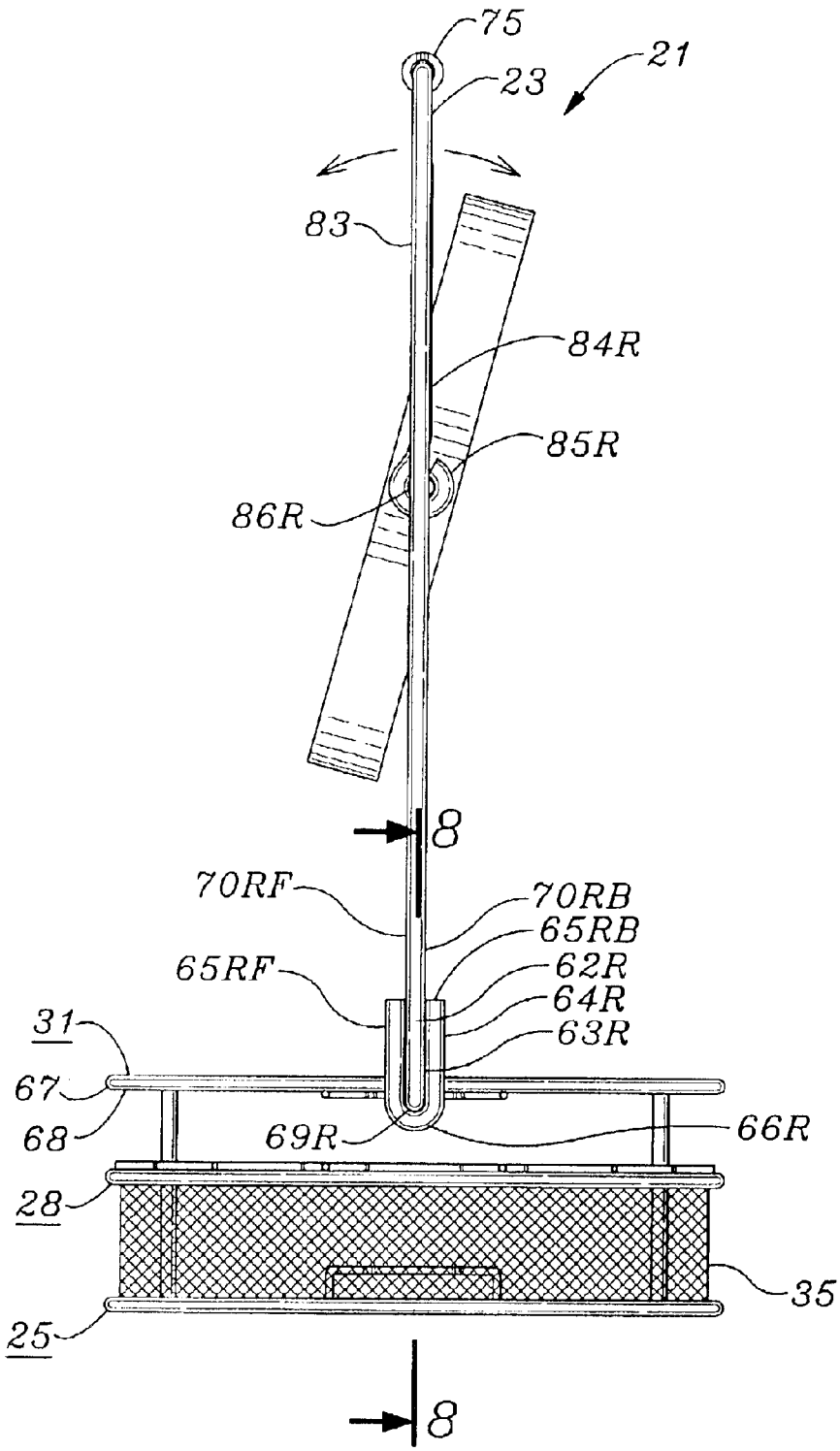
FIG. 3 is a right side elevation view of the article of FIG. 1, the left side elevation view being mirror symmetric therewith.
Figure 4:
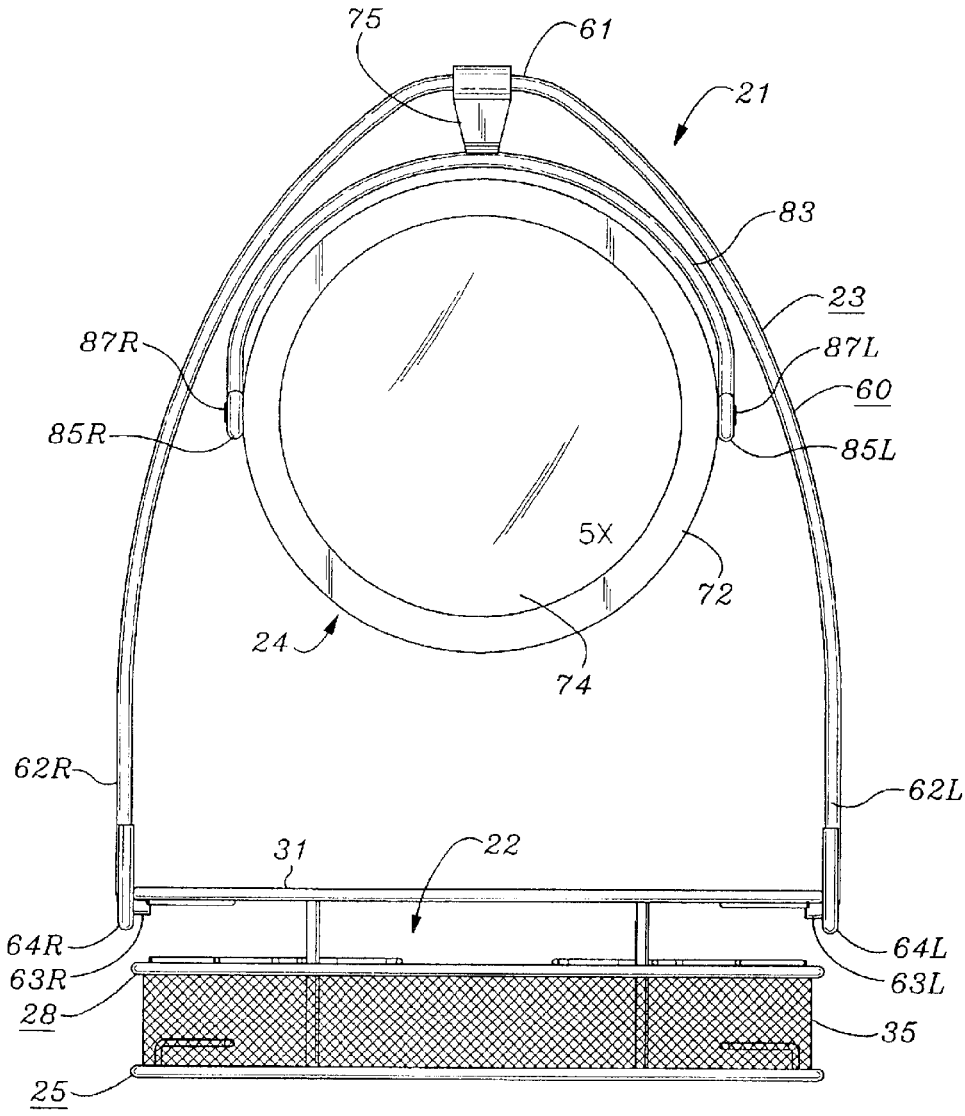
FIG. 4 is a rear elevation view of the article of FIG. 1.
Figure 7:
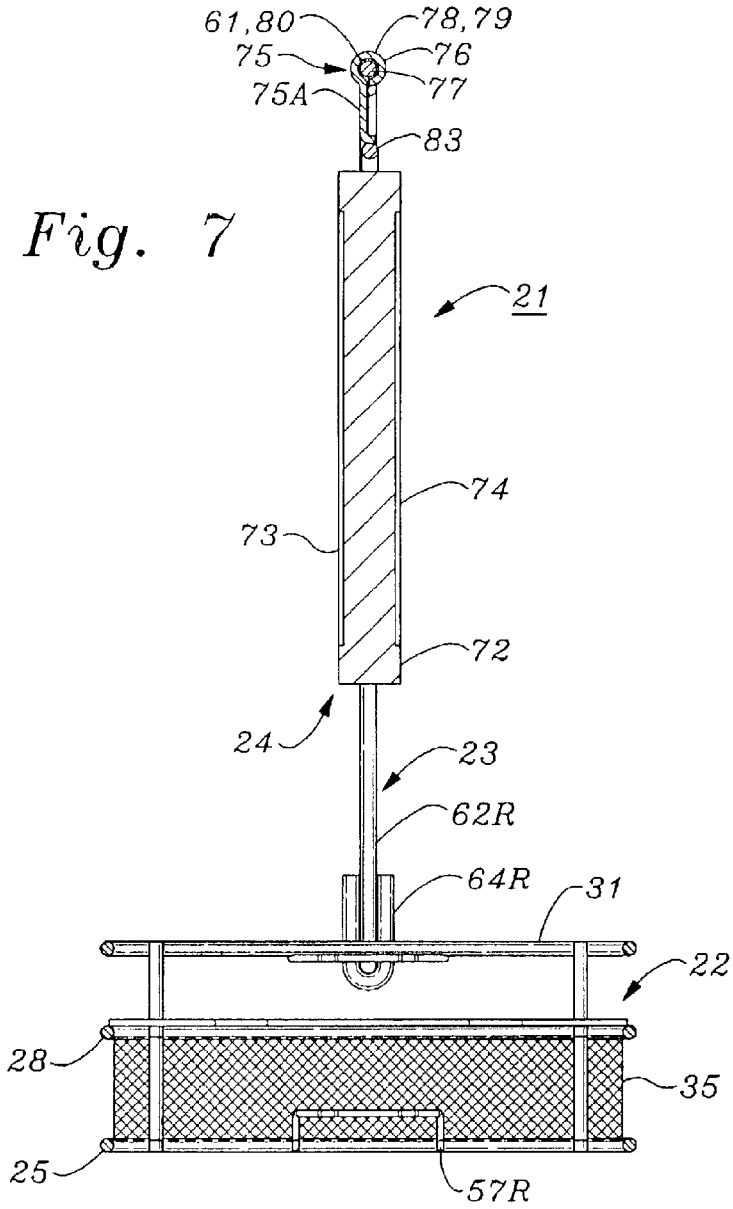
FIG. 7 is a vertical longitudinal sectional view of the article of FIG. 1, taken in the direction of line 7—7.
Figure 8:
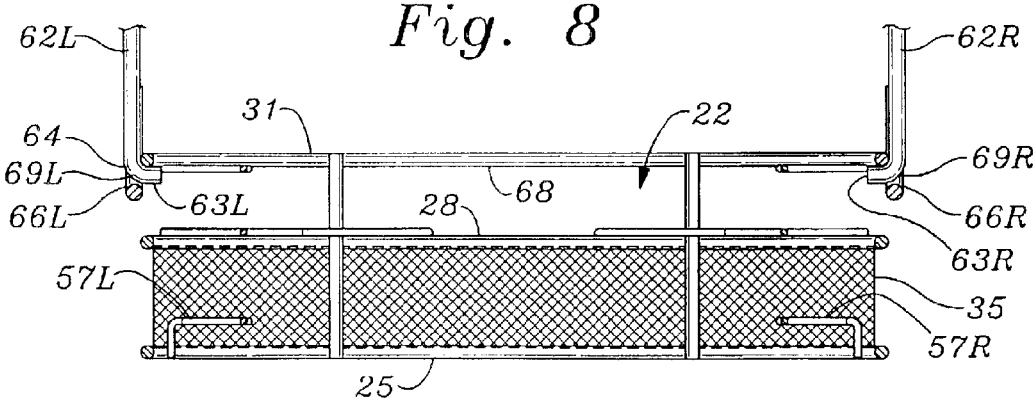
FIG. 8 is a vertical longitudinal sectional view of the article of FIG. 1, taken in the direction of line 8—8.

As may be seen best by referring to FIGS. 1, 2, 7 and 8, each tang 63L, 63R of handle-rod 60 is insertably received in a separate one of a pair of U-shaped handle mounting brackets 64L, 64R attached to opposite lateral ends of upper perimeter ring 31. Each U-shaped handle mounting bracket 64L, 64R has front and rear vertically disposed, longitudinally aligned parallel legs 65LF, 65LB, 65RF and 65RB, respectively, the lower ends of which join an upwardly concave, arcuately curved central segment 66L, 66R. The aforementioned straight front and rear legs of each handle mounting bracket 64L, 64R are attached to an outer circumferential surface 67 of upper perimeter ring 31, by welding, for example. As shown in FIG. 8, central arcuately curved segments 66L, 66R of handle mounting brackets 64L, 64R are spaced below lower surface 68 of upper perimeter ring 31, forming therewith a pair of generally cylindrically-shaped apertures 69L, 69R for insertably receiving handle bail tangs 63L, 63R. Moreover, as shown in FIGS. 1, 3, 5 and 7, parallel front and rear side legs 65LR, 65LB, and 65RF, 65RB of brackets 64L, 64R, abut front and rear sides 70F, 70B of lower straight segments 62 of handle 23, thus maintaining the handle upright. As shown in FIG. 4, lower straight segments 62L, 62R of handle 23 may be bent elastically apart to disengage end tangs 65 from handle brackets 64, thus allowing the handle to be removed from basket 22 and positioned parallel to the base of the assembly, thus enabling the knocked-down accessory 21 to be packaged substantially flat for storage and shipping.

As shown in FIG. 1, mirror assembly 24 of cosmetic basket/mirror accessory 21 includes a circular mirror frame 72 which holds therein a front circular mirror 73 of a given magnification, e.g, 1×. As shown in FIG. 4, mirror frame 72 may also hold a rear circular mirror 74 which has a different magnification than front mirror 73, e.g., 5×.

Figure 9:
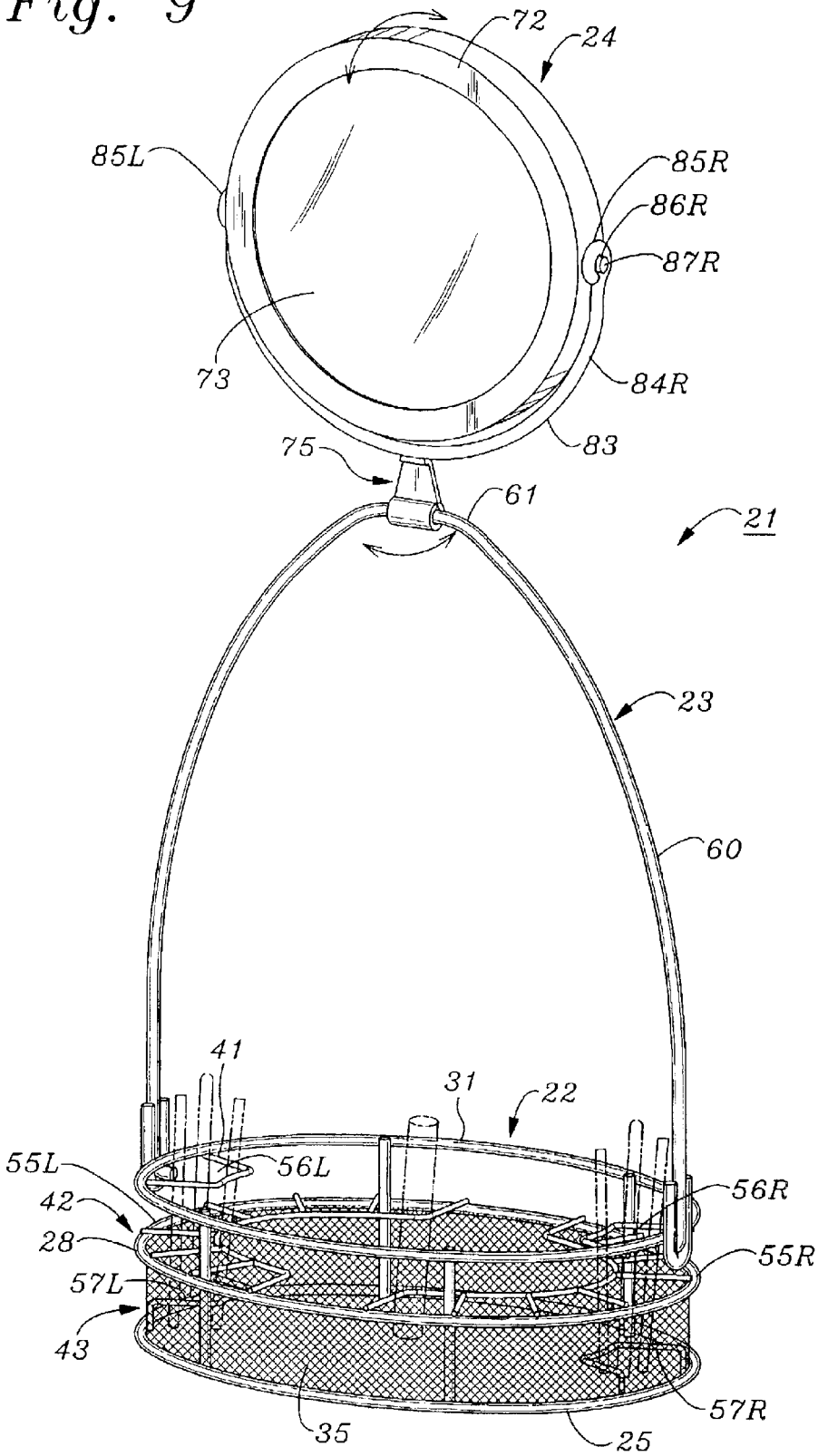
FIG. 9 is a front perspective view of the article of FIG. 1, showing a mirror thereof pivoted to an upward use position and showing how compartments of a basket portion of the article are used to hold cosmetic articles.

Mirror frame 72 is mounted to short, straight upper central portion 61 of handle 23 by means of a friction bracket 75. As shown in FIG. 7, friction bracket 75 has at one end thereof a tubular portion 76 which has a horizontally disposed cylindrical bore 77 in which is coaxially fitted a resilient friction tube 78. Friction tube 78 has an inner cylindrical wall surface 79 which fits tightly against outer surface 80 of straight central portion 61 of handle 23, exerting sufficient frictional force to maintain friction bracket 75 at any selected orbital position relative to straight central portion 61 of handle 23, such as a pendent position below the straight handle portion, as shown in FIG. 1, and a superior position above the handle, as shown in FIG. 9.

A preferred embodiment of cosmetic basket/mirror accessory 21 according to the present invention includes a mirror frame support cradle 82 interposed between mirror frame 72 and friction bracket 75. As shown in the figures, mirror frame support cradle 82 is made of a circular cross-section rod which is formed into the shape of a downwardly open, upwardly concave semi-circular arc segment 83. Opposite lateral ends 84L, 84R of arc segment 83 are bent perpendicularly outwards from the plane of the arc to form a pair of left and right, generally circular ring-shaped pivot eyes 85L, 85R. The latter have diametrically opposed, horizontally aligned bores 86L, 86R, which receive in a tight interference fit pivot pins 87L, 87R which protrude laterally outwards from opposite lateral sides of mirror frame 72. With this arrangement, mirror frame 72 may be pivoted about a horizontal axis through pivot pins 87L, 87R, as well as orbited about handle bail 23. Thus, mirror frame 72 may be tilted to any desired inclination angle relative to cradle 82, or rotated 180 degrees to position a front or rear mirror in front of a user as desired, as shown in FIG. 3.

What is claimed is:

1. A personal care accessory comprising an article container with adjustably configurable handle and mirror, for carrying cosmetic articles and viewing a person's face during their use, said accessary comprising:

a. an open cylindrically-shaped container, b. an inverted U-shaped bail type handle protruding upwardly from said container, c. a mirror assembly including at least a first mirror, and d. reconfigurable attachment means supporting said mirror assembly from said handle, said attachment means enabling said mirror assembly to be orbited between lower, pendent positions beneath an upper part of said handle, which lower positions facilitate grasping said handle for carrying said container, and upper positions above said handle, which are useful for viewing a person's face in said mirror.

2. The accessory of claim 1 wherein said reconfigurable attachment means which supports said mirror assembly from said handle is further defined as including;

a. a bracket which has a first end portion which is fastened to said handle in a manner enabling said bracket to be orbited around said handle to a selected polar angle relative thereto, and a second end portion fastened to support means for supporting said mirror, and b. locking means for securing said first end portion of said bracket at said selected polar angle.

3. The accessory of claim 2 wherein said locking means is further defined as being a friction member interposed between said bracket and said handle.

4. The accessory of claim 3 wherein said friction member is further defined as being a tubular, elastically deformable member which fits over said handle and within a tubular portion of said first end of said bracket.

5. The accessory of claim 1 wherein said reconfigurable attachment means which supports said mirror assembly from said handle is further defined as including;

a. a yoke which includes rotatable support means for rotatably supporting said mirror therewithin in a manner enabling said mirror to be rotated to a selected inclination angle, b. a bracket which has a first end portion which is fastened to said handle, and a second end portion which supports said yoke, and c. rotational motion retarding means for securing said mirror at said selected inclination angle relative to said yoke.

6. The accessory of claim 5 wherein rotatable support means for rotatably supporting said mirror within said yoke is further defined as comprising in combination;

a. a pair of opposed pivot pins which protrude radially outwardly from opposite sides of said mirror, and b. a pair of opposed pivot eyes at opposite sides of said yoke which rotatably receive said pivot pins.

7. The accessory of claim 6 wherein said rotational motion retarding means is further defined as being a frictional fit between said pivot pins and said pivot eyes.

8. The accessory of claim 5 wherein said first end portion of bracket is further defined as being fastened to said handle in a manner enabling said bracket to be orbited around said handle to a selected polar angle relative thereto, and secured at said selected angle by locking means.

9. The accessory of claim 1 further including releasable attachment means for releasably attaching said handle to said container.

10. The accessory of claim 1 wherein said releasable attachment means is further defined as comprising in combination a pair of opposed, elastically deformable lower vertical end portions of said handle, a pair of inwardly protruding end tangs protruding from each of said lower vertical end portions, and a pair of opposed apertures located in opposite sides of said container, whereby said vertical sides of said handle are elastically deformable outwardly from one another to disengage said handle tangs from said container apertures to release said handle from said container, and said outwardly displaced tangs are positions adjacent to said apertures and said handle allowed to return to its undeformed state to thereby secure said tangs within said apertures.

11. The accessory of claim 1 wherein said container is further defined as a basket comprising in combination;

a. a base perimeter ring defining a base plane, b. a plurality of circumferentially spaced apart struts attached to said base ring which protrude perpendicularly upwards from said base plane c. an intermediate perimeter ring spaced above and parallel to said base ring and attached to said struts, d. an upper perimeter ring spaced above and parallel to said intermediate ring and attached to said struts, e. a base panel which is parallel to said base plane of said base ring and which covers a space enclosed by said ring, and f. a side wall which protrudes upwardly from said base plane and which covers a ring-shaped vertical surface of said basket extending from said base to at least said intermediate ring.

12. The accessory of claim 11 further including releasable handle attachment means for releasably attaching said handle to said basket, said releasable handle attachment means comprising in combination;

a. a pair of generally vertically disposed lower end portions of said handle which are spaced laterally apart at a first lateral distance, and elastically deformable to a second, larger distance, said pair of lower end portions of said handle terminating in a pair of opposed, inwardly facing end tangs, and b. a pair of opposed apertures located in opposite sides of said container, said apertures being of a proper size to insertably receive said tangs when said lower end portions of said handle are forced elastically apart by a separating force to said second distance, and retain said tangs when said lower end portions of said handle are allowed to return towards said first, unstressed distance when said separating force is removed.

13. The accessory of claim 12 wherein said opposed apertures for receiving said tangs are further defined as comprising a pair of generally cylindrically-shaped spaces formed between a lower surface of said upper perimeter ring and a U-shaped bracket attached to an outer lateral side of said ring with a curved portion thereof located below said lower surface of said upper perimeter ring.

14. The accessory of claim 11 further including a plurality of planar, ring-shaped partitions which protrude radially inwards from and parallel to at least one of said base perimeter ring, said intermediate perimeter ring and said upper perimeter ring.

15. A personal care accessory consisting of a cosmetic articles basket with adjustably configurable handle and mirror, said accessory comprising:

a. an open cylindrically-shaped basket which includes a plurality of frame rings including a base perimeter ring, at least one intermediate perimeter ring spaced above and parallel to said base ring, and an upper ring spaced above and parallel to said base perimeter ring, said frame rings being fastened together by a plurality of circumferentially spaced apart struts disposed perpendicularly to respective planes of said frame rings, a horizontally disposed base panel disposed parallel to and covering said base ring, and a vertically disposed side wall circumferentially overlying at least one of said frame rings, b. an inverted U-shaped, bail type handle which has a pair of generally vertically disposed, laterally spaced apart lower segments, each of which has a arcuately inwardly and upwardly curved segment which joins outer ends of a straight, horizontally disposed upper center segment, said lower handle segments terminating in a pair of opposed inwardly protruding tangs, which are attached to said upper frame ring of said basket, c. a mirror assembly which includes a mirror frame, and at least a first mirror held with said frame, and d. a reconfigurable mirror support assembly which includes, (I) an inverted U-shaped yoke provided with a pair of laterally opposed pivot eyes which pivotably receive a pair of laterally opposed pivot pins that protrude radially outwardly from opposite sides of said mirror frame, whereby said mirror frame may be tilted about an axis through said pivot eyes to a selected inclination angle, and (II) a yoke support bracket which has at a first end thereof a tubular portion which frictionally receives said upper straight segment of said handle, and a second end thereof attached to said yoke, whereby said bracket and cradle may be orbited around said upper straight segment of said handle to a selected polar angle relative thereto.

16. The accessory of claim 15 wherein said lower segments of said handle are further defined as being elastically deformable outwardly from one another to disengage said tangs from handle bracket means attached to said basket.

17. The accessory of claim 16 wherein said handle bracket means is further defined as comprising a pair of laterally spaced apart, parallel U-shaped members attached to opposite sides of said upper perimeter frame ring of said basket, each of said U-shaped members having a front, vertically disposed segment, a rear vertically disposed segment, and an arcuately curved segment which joins said front and rear segments, said curved segment protruding below a lower surface of said upper perimeter ring to form therewith an aperture for receiving said handle tang.

18. The accessory of claim 15 wherein said basket is further defined as including a plurality of planar, ring-shaped partitions which protrude radially inwards from and parallel to at least one of said base perimeter ring, intermediate ring, and said upper perimeter ring, whereby individual elongated cosmetic articles can be separately positioned within respective ones of said partitions resting on said base panel.

19. The accessory of claim 18 wherein at least one pair of said partitions is vertically aligned to thereby form a cylindrically-shaped article storage compartment.

20. The accessory of claim 15 wherein said basket is further defined as having a curvilinear plan view shape.

21. The accessory of claim 20 wherein said plan view shape of said basket is further defined as being oval.

22. The accessory of claim 21 wherein said lower handle segments are further defined as being attached at opposite ends of a major axis of said oval.

23. The accessory of claim 21 wherein said plan view shape of said basket is further defined as being circular.

* * * * *